US005440793A

United States Patent [19]

Yoshioka

[11] Patent Number: 5,440,793

[45] Date of Patent: Aug. 15, 1995

[54] PROCESS FOR PRODUCTION OF FUR ENHANCED FABRIC

[76] Inventor: Yukio Yoshioka, 2723-2 Oaza Hukawa, Tone-machi Kitasoma-gun Ibaraki-ken, Japan

[21] Appl. No.: 162,769

[22] Filed: Dec. 8, 1993

[30] Foreign Application Priority Data

Dec. 8, 1992 [JP] Japan ..... 4-351701

[51] Int. Cl.[6] ..... C14B 15/00; D02G 3/02; D06B 1/00

[52] U.S. Cl. ..... 28/100; 69/22; 69/48; 57/235

[58] Field of Search ..... 57/31, 235, 260; 28/167, 299, 100; 69/19.1, 22, 48

[56] References Cited

U.S. PATENT DOCUMENTS

| | | | |
|---|---|---|---|
| 3,748,212 | 7/1973 | Piampiano et al. | 69/22 X |
| 3,850,013 | 11/1974 | Polvara | 69/19.1 X |
| 4,100,773 | 7/1978 | Respetto | 69/48 |
| 4,292,691 | 10/1981 | Forrest et al. | 69/22 X |
| 4,507,943 | 4/1985 | Viljanmaa | 69/48 X |
| 4,606,182 | 8/1986 | Krehm et al. | 57/260 X |
| 4,637,206 | 1/1987 | Suwa | 57/260 X |
| 4,660,363 | 4/1987 | Krehm et al. | 57/260 X |
| 5,167,113 | 12/1992 | Yoshioka | 57/260 X |

FOREIGN PATENT DOCUMENTS

| | | | |
|---|---|---|---|
| 4458 | 10/1979 | European Pat. Off. | 57/235 |
| 357221 | 1/1973 | U.S.S.R. | 69/22 |

*Primary Examiner*—Clifford D. Crowder
*Assistant Examiner*—John J. Calvert
*Attorney, Agent, or Firm*—Lowe, Price, LeBlanc & Becker

[57] ABSTRACT

A fur strip 6 is wound on each of warp yarns 2 and weft yarns 3 of a net 4 to have a hair side 6*a* of the fur strip 6 disposed outside the net 4 so as to form a hairy textile fabric element 7, the net 4 being woven by interlacing the warp yarns 2 with the weft yarns 3 and having end portions of the yarns 2, 3 trimmed with an edge member 5 to form a part fabric base 1. The hairy textile fabric element 7 is treated with water by spraying water thereon or by immersion in water. The part fabric base 1 is temporarily fixed to a predetermined template to permit the fur strips 6 to be dried and hardened. In the method, adjacent ones of the fur strips 6 wound on the warp yarns 2 or on the weft yarns 3 are opposed in winding direction to each other.

7 Claims, 2 Drawing Sheets

PROCESS FOR PRODUCTION OF FUR ENHANCED FABRIC

BACKGROUND OF THE INVENTION

1. Field of the Invention

The present invention relates to a method for manufacturing a hairy textile fabric, which is used in garments such as coats, overcoats, shawls and the like.

2. Description of the Prior Art

It has been already known to manufacture a hairy textile fabric, in which a strip of fur (hereinafter referred to as the fur strip) is wound on each of base yarns such as warp yarns or weft yarns of a fabric base trimmed with an edge member, the fabric base assuming a predetermined shape or pattern of, garmet parts such as front bodies, back bodies, sleeves and the like, for example. However, in a conventional method for manufacturing the hairy textile fabric, the fur strip having been dried is merely wound on each of the base yarns of the fabric base.

In the conventional method described above, when the fur strip is spirally wound on each of the base yarns, each of the base yarns is pulled by the thus wound fur strip to acquire wrinkles so that the fabric base having been combined with the fur strips to form a hairy textile fabric is deformed into a useless shape different from a predetermined shape or pattern.

Consequently, it is necessary to correct in shape the thus deformed hairy textile fabric, for example, by fixing it to a working bench by means of pins and the like after it is corrected in shape. However, since the fur strips of the hairy textile fabric have been dried and hardened, such correcting operation of the shape or pattern of the hairy textile fabric takes too much time and effort, which increases manufacturing costs.

SUMMARY OF THE INVENTION

It is an object off the present invention to provide a method for manufacturing a hairy textile fabric in which a fabric base is combined with fur strips, in which method the hairy textile fabric is corrected in shape in an easy manner to assume a predetermined shape, whereby disadvantages inherent in the conventional method are removed.

According to a first aspect of the present invention, the above object of the present invention is accomplished by providing:

A method for manufacturing a hairy textile fabric in which a fabric base is combined with fur strips, comprising the steps of:

spirally winding each of the fur strips on each of warp yarns or weft yarns of a net to have a hair side of each of the fur strips disposed outside the net so as to Form a hairy textile fabric element, the net being woven by interlacing the warp yarns with the weft yarns and having end portions of the warp and the weft yarns trimmed with an edge member to form a part fabric base;

treating the hairy textile fabric element with water by spraying water thereon or by immersing it in water; and temporarily fixing the part fabric base to a predetermined template to permit the fur strips to be dried and hardened.

According to a second aspect of the present invention, the above object of the present invention is accomplished by providing:

The method For manufacturing the hairy textile fabric, as set forth in the First aspect of the present invention, wherein:

adjacent ones of the fur strips wound on the warp yarns or on the weft yarns are opposed in winding direction to each other.

In the method of the present invention, as described above, since the hairy textile fabric element (in which the strip or fur, i.e., fur strip is wound on each of the warp yarns or the weft yarns of the fabric base) is treated with water, the fur strips are softened, which facilitates the correcting operation of the shape or pattern of the hairy textile fabric element.

Further, in the method of the present invention, since adjacent ones of the fur strips wound on the warp yarns or on the weft yarns are opposed in winding direction to each other, forces applied to the warp yarns or the weft yarns by the fur strips thus wound thereon are entirely canceled with each other, which permits the hairy textile fabric element to assume a predetermined shape dr pattern.

DESCRIPTION OF THE PREFERRED EMBODIMENTS

Hereinbelow, the present invention will be described in detail with reference to the accompanying drawings.

Figure 1:
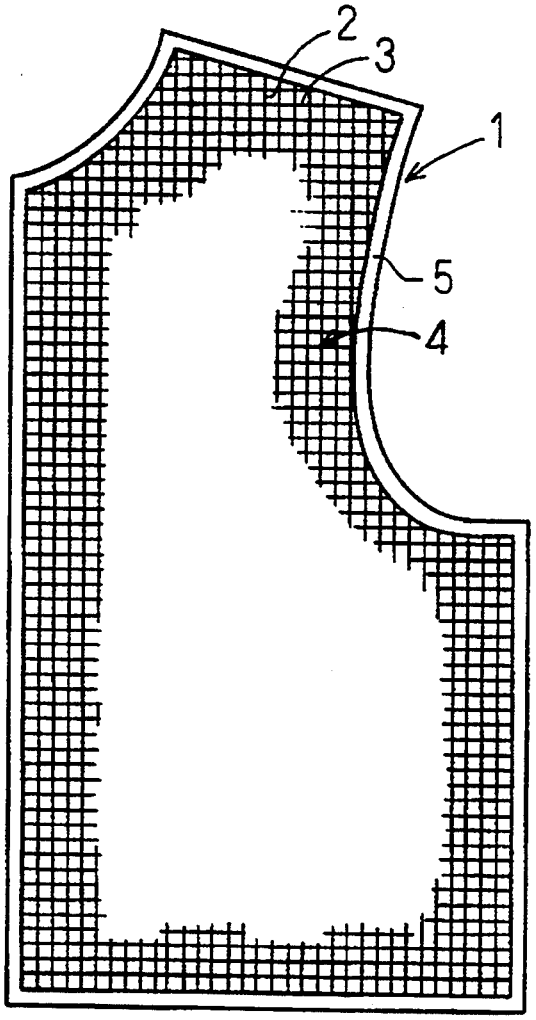
FIG. 1 is a plan view of an example of a part fabric base used in the method of the present invention.

FIG. 1 shows a part of a garment, which forms a fabric base 1 of, for example such as front bodies, back bodies and the like in the fabric base 1, a plurality of warp yarns 2 are woven with a plurality of weft yarns 3 to form a net 4 which is trimmed with an edge member 5 to assume a predetermined shape or pattern.

Figure 2:
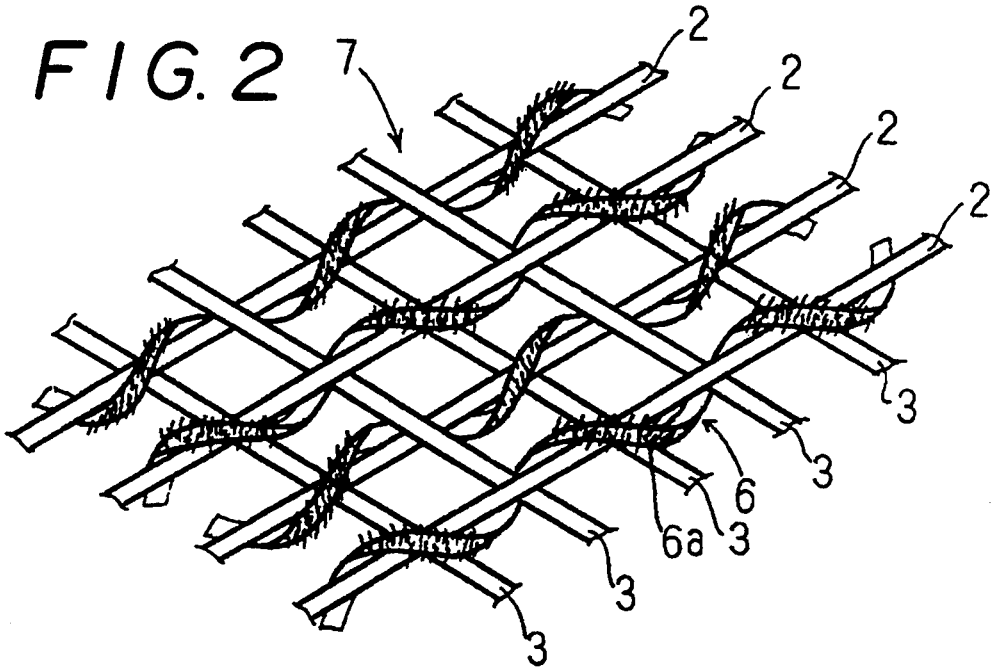
FIG. 2 is a partially enlarged perspective view of the part fabric base shown in FIG. 1, the part fabric base having been combined with the strips of furs.
Figure 3:
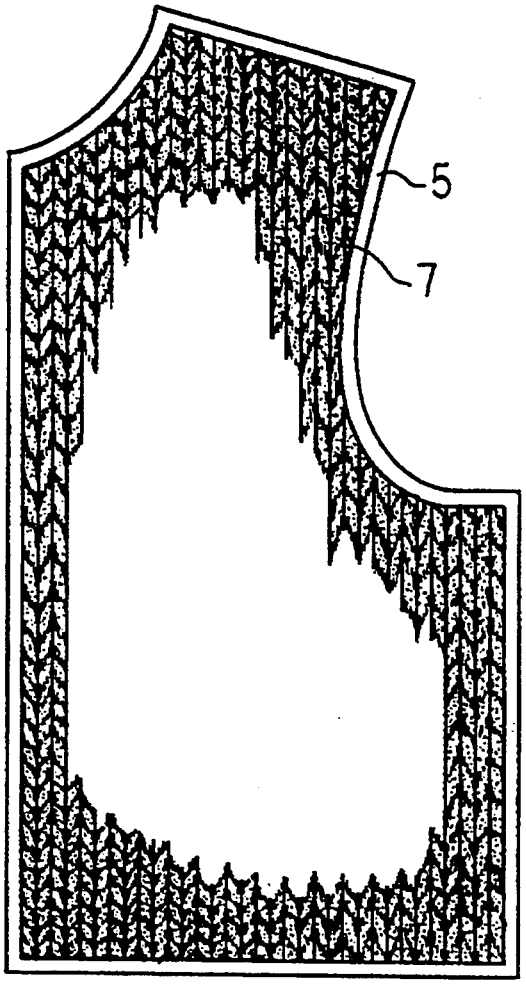
FIG. 3 is a plan view of the completed part fabric made out of the hairy textile fabric according to the present invention.

In FIG. 2, a fur strip 6 is spirally wound on each of base yarns such as the warp yarns 2 or weft yarns 3 of the fabric base 1 to form a hairy textile fabric element 7 in which: the fur strips 6 have their hair sides **6*a* disposed outside the net 4; and, adjacent ones of the fur strips 6 are wound on the base yarns such as the warp yarns 2 or the weft yarns 3** are opposed in winding direction to each other.

The hairy textile fabric element 7, in which each of the fur strips 6 is wound on each of the base yarns in a manner described above, is treated with water by spraying water thereon or by immersing the hairy textile fabric element 7 in water. After that, the edge member 5 of the hairy textile fabric element 7 thus treated with water is temporarily fixed to a working bench (not shown) by means of a plurality of pins (not shown), so that the hairy textile fabric element 7 is corrected in shape or pattern and dried to become a completed fur product.

In the manufacturing process of the present invention described above, since each of the fur strips 6 is wound on each of the base yarns such as the warp yarns 2 or the weft yarns 3 of the fabric base 1 to form the hairy textile fabric element 7, the fabric element 7 tends to wrinkle under the influence of a pulling force exerted by each of the thus wound fur strips 6 so that the fabric base 1 entirely tends to shrink.

In order to correct the shape or pattern of the hairy textile fabric element 7, it is necessary to stretch the thus shrunk fabric base 1 by fixing the base 1 to the working bench so as to have the fabric base 1 assume a predetermined shape or pattern. In such stretching operation of the fabric base 1, if the hairy textile fabric element 7 were a dry one, such stretching operation would take too much time and effort, and, therefore would increase manufacturing costs.

Consequently, in the method of the present invention, the stretching operation of the fabric base 1 is performed after the hairy textile fabric element 7 is treated with water, for example, by spraying water thereon or by immersing it in water to soften the fur strips 6 of the element 7.

As a result, the shrunk hairy textile fabric element 7 is corrected in shape or pattern in an easy manner to assume a predetermined shape or pattern, which cuts the manufacturing costs.

Further, in the method of the present invention, since each of the fur strips 6 having been treated with water is then dried and hardened in an appropriately shrunk condition thereof, the fur strips 6 are firmly combined with the base yarns such as warp yarns 2 or the weft yarns 3, which enables the hairy textile fabric element 7 to be hardly deformed after the element 7 is finished.

If adjacent ones of the fur strips 6 wound on each of the base yarns such as the warp yarns 2 or the weft yarns 3 were the same in winding direction, the fabric base 1 would be biased and deformed under the influence of forces exerted by the thus wound fur strips 6. In order to avoid the above disadvantage, in the method of the present invention, adjacent ones of the fur strips 6 wound on each of the base yarns such as the warp yarns 2 or the weft yarns 3 are opposed in winding direction to each other, so that the forces applied on the base yarns by the fur strings 6 are canceled with each other, whereby the hairy textile fabric element 7 is prevented from being biased or deformed after the element 7 is finished.

According to the method of the present invention, it is possible to manufacture a product of the hairy textile fabric in an easy manner at low cost, which cuts the manufacturing costs and realizes hairy textile fabric products excellent in price-and-quality competition in the market.

What is claimed is:

1. A process for production of fur enhanced fabric in which a fabric base is combined with fur strips, comprising the steps of:

trimming end portions of warp yarns and weft yarns of a net with an edge member to form a part fabric base, said net woven by interlacing the warp yarns with the weft yarns;

spirally winding each of the fur strips on each of the warp yarns or the weft yarns of said part fabric base to have a hair side of each of the fur strips disposed outside the net so as to form a hairy textile fabric element;

treating the hairy textile fabric element with water by spraying water thereon or by immersing it in water; and temporarily fixing the part fabric base to a predetermined template to permit the fur strips to be dried and hardened.

2. The process for production of fur enhanced fabric, as set forth in claim 1, wherein:

adjacent ones of the fur strips wound on the warp yarns or on the weft yarns are opposed in winding direction to each other.

3. A process for production of fur enhanced fabric in which a fabric base is combined with fur strips, comprising the steps of:

weaving a net by interlacing warp yarns with weft yarns;

trimming end portions of the warp yarns and weft yarns of the net with an edge member to form a fabric base for a garment part;

spirally winding each of the fur strips on each of the warp yarns or the weft yarns of said part fabric base to have a hair side of each of the fur strips disposed outside the net so as to form a hairy textile fabric element;

treating the hairy textile fabric element with water; and temporarily fixing the part fabric base to a predetermined template to permit the fur strips to be dried and hardened.

4. The process as set forth in claim 3, wherein said step of treating the hairy textile fabric element with water comprises spraying water on the hairy textile fabric element.

5. The process as set forth in claim 4, further comprising the step winding the fur strips on adjacent ones of the warp yarns or the weft yarns in opposite winding direction.

6. The process as set forth in claim 3, wherein said step of treating the hairy textile fabric element with water comprises immersing the hairy textile fabric element in water.

7. The process as set forth in claim 6, further comprising the step winding the fur strips on adjacent ones of the warp yarns or the weft yarns in opposite winding direction.

* * * * *